United States Patent [19]

Nishino et al.

[11] 4,083,319

[45] Apr. 11, 1978

[54] BARGE SHIP DUAL TRUCKS TO TRANSPORT BARGES THEREON

[75] Inventors: Yasushi Nishino, Akashi; Koji Karashima, Kobe; Ken Iwai, Yokohama, all of Japan

[73] Assignee: Mitsubishi Jukogo Kabushiki Kaisha, Tokyo, Japan

[21] Appl. No.: 658,522

[22] Filed: Feb. 17, 1976

[30] Foreign Application Priority Data

Nov. 14, 1975 Japan ..... 50-137079

[51] Int. Cl.[2] ..... B63B 35/40

[52] U.S. Cl. ..... 114/260; 212/3 R; 214/15 R

[58] Field of Search ..... 212/3; 214/15 R, 390, 214/75 R, 759, 75 H, 750, 730; 114/72.73, 258–260

[56] References Cited

U.S. PATENT DOCUMENTS

| | | | |
|---|---|---|---|
| 2,792,130 | 5/1957 | Fetchko | 214/15 R |
| 2,828,876 | 4/1958 | Parnie | 214/75 H |
| 2,988,036 | 6/1961 | Mooneyhan et al. | 114/43.5 VC |
| 3,145,863 | 8/1964 | Dunaski | 214/390 |
| 3,386,405 | 6/1968 | Knight, Jr. et al. | 214/15 R X |
| 3,515,086 | 6/1970 | Auzins et al. | 114/43.5 VC |
| 3,519,147 | 7/1970 | Walda | 214/15 R |
| 3,672,634 | 6/1972 | Chaffin | 214/390 X |
| 3,687,309 | 8/1972 | Macronder | 214/15 R |
| 3,734,312 | 5/1973 | Hickinbotham | 214/730 X |

FOREIGN PATENT DOCUMENTS

| | | | |
|---|---|---|---|
| 2,421,396 | 11/1975 | Germany | 214/16.4 A |

*Primary Examiner*—Robert J. Spar
*Assistant Examiner*—R. B. Johnson

[57] ABSTRACT

A barge-carrying ship comprising a crane of a lifting-beam type installed at the end of the ship for hoisting barges afloat, runway rails laid on the upper deck and along the inner walls of the both sides of the hull, barge-end-holding trucks disposed in pairs on the rails to travel thereon, each pair of said trucks being capable of taking over a hoisted barge from the crane and carrying the barge while supporting the same at both ends, and another lifting-beam crane installed amidships along a hatch opening of the deck for hoisting the barge from the pair of trucks and lowering or raising the load.

7 Claims, 5 Drawing Figures

BARGE SHIP DUAL TRUCKS TO TRANSPORT BARGES THEREON

This invention relates to a ship for transporting a number of barges or lighters carried above and below its main deck, and more specifically to such a barge-carrying ship capable of handling the barges from and to the water surface at one end of the ship.

A conventional barge-carrying ship of the character has on its deck a traveling crane for handling barges. The crane lifts barges onto the stern, stow and stack them in the holds through hatch openings of the deck. The barges can also be placed over the hatch covers.

The ship thus requires many hatch openings, transverse bulkheads, and sometimes barge guides. Accordingly, the barges placed above and below the deck leave so much unoccupied spaces in front and in the rear that the number of such craft to be carried is limited.

An additional problem is that the traveling crane, the only means for handling, takes much time in moving all of the barges up and down and back and forth, with a consequent slowing down of the cargo handling operation.

A barge-carrying ship of another conventional design lifts barges by means of an elevator at the stern, moves a truck from the deck into the space under each barge in the lifted position, and then lowers the barge onto the truck for subsequent shipboard stowage. Among the problems of this ship are the unavailability of the hold spaces below the deck for barge accommodation, impossibility of barge shifting between upper and lower decks, and difficulties in sorting the barges by the ports of destination, particularly when the ship is to call on many ports, because of the limited deck areas available for the barges as sorted.

The present invention contemplates the solution of these problems of the conventional barge-carrying vessels. Thus, the invention aims to provide a ship capable of carrying an increased number of barges with an improved loading and unloading efficiency and ease of trimming, the ship itself being simplified in construction.

According to this invention, the barge-carrying ship comprises a lifting-beam crane located at the end of the vessel for lifting barges from the water surface onto the deck, pairs of barge trucks arranged on the deck and inboard and adapted to travel, with each lifted barge held therebetween, on rails laid along the inner walls of the both sides of the vessel, and another lifting-beam crane installed amidships along a hatch opening of the deck to lift each barge from the trucks and lower the same into the hold.

According to another feature of the invention, the barge-carrying ship further comprises a hinged double door for an end opening of the hull, and extension runway rails secured to the lower parts on the inner sides of the both wings so that when the door is open the rails connect to corresponding inboard rails, said extension rails being set in parallel with the sides of the ship upon opening of the door to permit the lifting beams of the crane at the ship's end to be lowered and raised in between.

Other objects, features and advantages will become more apparent from the following description taken in conjunction with the accompanying drawings showing an embodiment thereof. In the drawings.

Figure 1:
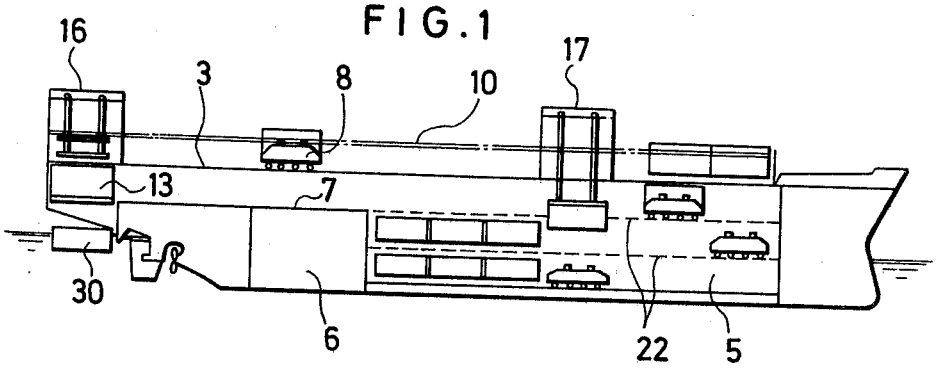
FIG. 1 is an inboard profile of a barge-carrying ship embodying the invention.

Referring to the drawings, there is shown a barge-carrying ship 1 whose sides are both of a double-hull structure 2. The sides are partitioned at suitable intervals in the fore-and-aft direction to provide subdivisions for the vessel stability against flooding in case of a hull damage.

The upper deck 3 has no opening with the exception of a hatch opening 4 formed in a midship crane section.

Also, in the hold 5, there is no deck other than a lower deck 7 which constitutes the roof of the engine room 6.

On the broadside portions facing the upper deck 3, there are laid runway rails on which barge-end-holding trucks 8 are to travel, upper rails 10, and upper-rail supports 11 are installed at suitable intervals in the fore-and-aft direction. In addition, barge rests 12 are made fast to the points of the deck where the barges in transit are to lie.

A stern door 13 of the hinged double-wing type is provided for a barge-loading opening at the stern and below the deck 3. To the lower parts of the inner sides of the both wings are secured extension runway rails 15, which are aligned to corresponding inboard rails 14 when the door is open. Movable intermediate rails 15' are located between the inboard rails 14 and the extension rails 15.

The movable intermediate rails 15' are used, when the door 13 is open, to connect the rails 14 and 15. For this purpose the rails 14 are equipped with conventional coupling aids as, for example, means for pivotally supporting the rails at one ends so that they can be turned or fixed as desired.

In the aft and midship parts of the ship, cranes 16, 17 of the lifting beam type are fixedly mounted, respectively, each with lifting beams 18 for firmly holding each barge during the crane operation. The lifting beams 18 of the stern crane 16 are connected through buffer links 19 to guide beams 20 so as to absorb much of wave shocks. Normally the barge-carrying levels beneath the upper deck 3 are not required to have any deck. To the inner walls 21 of the double-hull structure are secured rail supports 22 extending fore and aft to support both the runway rails 14 and barge rests 23.

Figure 5:
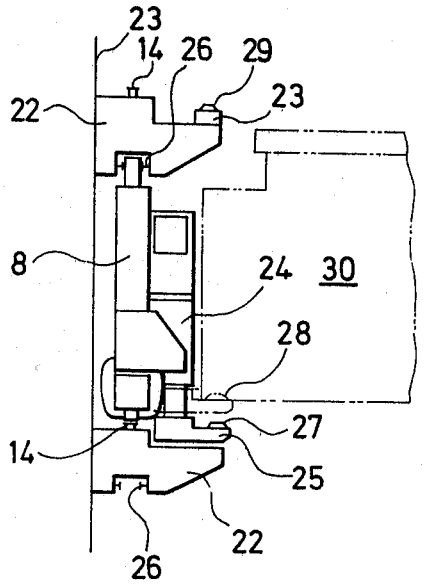
FIG. 5 is an enlarged view of a barge-end-holding truck and the associated parts for carrying a barge.

One of the barge-end-holding trucks 8 is illustrated in detail in FIG. 5 as having an inwardly protruding prong 25, which can be driven by a hydraulic jack 24 upwardly and downwardly and also for a 90° turn around the vertical axis of the jack. The trucks 8 are self-driven to travel fore and aft along the runway rails 14 and upper rails 26 both of which are supported by the supports 22 above and under the trucks.

Figure 2:
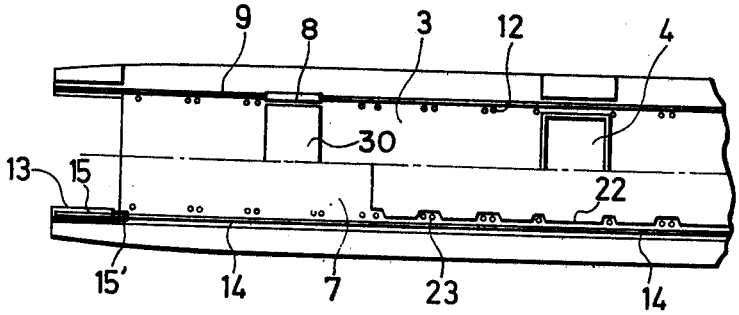
FIG. 2 is a plane view of the essential parts of FIG. 1, the upper half of the figure being a top view and the lower half a transverse section.
Figure 3:
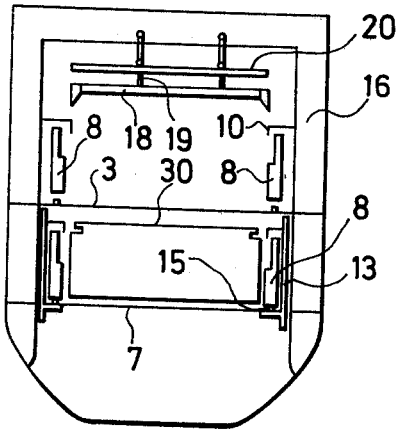
FIG. 3 is an enlarged cross sectional view of the aft part of the barge-carrying ship.
Figure 4:
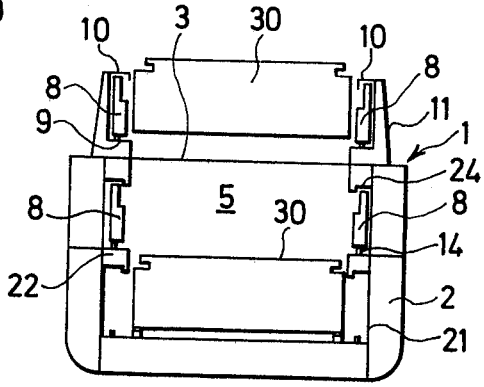
FIG. 4 is an enlarged cross sectional view of the midship part.

Each prong 25 has on its upper surface an upward protrusion 27 adapted to engage a corresponding recess 28 of the matching contour formed on the bottom of each barge 30. There are additional recesses of the same contour formed at the corners of the underside of the barge and engageable with upward protrusions 29 of the barge rests 23 shown in FIGS. 2 and 5.

Power spply and transmission of control signals from the sources aboard the ship to the trucks 8 are done by means of a cable or trolley system.

With the construction described, the barge-carrying ship according to the invention is loaded with barges 30 in the following way. The stern door 13 of the ship at anchor is opened, its two wings are fastened immovably to the both sides of the vessel, and the runway rails 14, 15 are connected by the movable intermediate rails 15'. Then, the barges 30 afloat are caught, one by one, by the lifting beams 18 of the stern crane 16.

With its pitch and roll absorbed by the buffer links 19, each barge 30 is hoisted, following the guide beams 20, to a desired loading level of the ship.

Next, a pair of the barge-end-holding trucks 8, with their prongs 25 lifted up, travel in pair on the runway rails 9 over the deck or on the extension rails 15 on the lower inner sides of the wings of the stern door 13, and stop at the point immediately under the hoisted barge 30.

The barge is then lowered by the stern crane 16 until it is supported at both ends by the end trucks, with the upward protrusions 27 of the prongs 25 fitted in the recesses 28 at the bottom of the barge, and the lifting beams 18 are disengaged from the craft.

Having taken over the barge 30 from the crane, the trucks 8 cooperatively carry the load, running clear of the upward protrusions 29 of the barge rests 12 and 23 on the way, to a desired location for stowage. The trucks lower their prongs 25 and allow the barge 30 to lie on the rests 23.

After this, the unloaded trucks 8 turn their prongs 90° and lift them up, and go back to the position where they are to receive the next barge.

When a barge 30 is to be shifted from level to level, it is carried by a pair of trucks 8 to the midship crane section and is hoisted from the trucks by the midship crane 17.

For shifting to an upper level, the barge 30 is craned up to the particular level, a pair of trucks 8 on that level are moved to the both ends of the barge, and the afore-described procedure is repeated to transfer the barge from the crane to the trucks.

For downward shifting, the barge 30 is carried by the trucks 8 to the midship crane section and is lowered by the midship crane 17 to a lower level, and then is placed on the pair of trucks belonging to the particular level, in the same manner as above described.

The same procedure of barge handling applies to the unloading and also to the cargo trimming aboard the ship.

Proper means of known designs are provided to sense the movements of the individual cranes and barge-end-holding trucks and their relative motions. Should any sign of irregularity be detected, an alarm will be given and an interlock mechanism will work to prevent its development to a trouble or hazard.

With the construction and features described hereinabove, the barge-carrying ship of the invention offers the following advantages:

1. Decks inside the hold part are omitted and the wasteful hold space in the direction of height of the vessel is minimized.

2. The use of the barge-end-holding trucks adds to the reduction in the loss of the vertical hold space.

3. Level-to-level shifting of barges and cargo trimming aboard the ship are made easy and simple by the adoption of the hatch crane.

4. The number of openings in the deck is reduced to but one so that the hull strength is increased and more stowage space is available on the deck than heretofore.

5. Since the hinged double door is provided at the end of the ship, with extension runway rails attached to the lower parts on the inner sides of the door wings, no leveling is required for the extension rails at their connections to the inboard runway rails, and the connection work is remarkably simplified.

6. The lifting-beam cranes installed at the end of the ship and over the hatch of the upper deck combine with the trucks that travel therebetween to handle barges more speedily and safely than does a single traveling crane. In addition, this barge-handling arrangement is less costly than the conventional ones.

What is claimed is:

1. A barge carrying ship comprising a hull having sides, a plurality of vertically spaced decks for supporting barges, an open hold beneath at least one of said decks for storing barges, a hatch opening in one of said decks at midship communicating with said hold and at least one lower deck, a first elevator located at one end of said hull for lifting and lowering a barge to and from said decks, a second elevator mounted in said hatch opening and operative to transfer a barge between said decks and said hold, pairs of rail means mounted on each of said decks, said rail means on one of said decks extending between said first and second elevators, truck means movably mount on said rail means and operative to transport barges along said decks and between said first and second elevators, said truck means comprising pairs of independent and separate barge-end-holding trucks, each pair of said truck means being adapted to operate in unison, each of said trucks having a horizontally extending cantilevered prong mounted thereon, means for pivoting said prong about a vertical axis from a first position parallel to said sides of said hull to a second position normal and inwardly of said sides, means for vertically moving said prongs to lift and deposit said barges relative to said deck, hold and elevators and means on said elevators to transfer barges to and from a respective pair of said truck means.

2. The barge carrying ship according to claim 1 including drive means for propelling each of said truck members and means for actuating the drive means of each associated pair of truck members simultaneously.

3. The barge carrying ship according to claim 1 including an opening for access to said hold at the stern of said ship and including a pair of doors for closing said stern opening in fluid tight condition, said doors being hingedly secured to the hull of said vessel to be movable into an open position against the sides thereof, said first elevator means being located at said stern to present barges thereat and said doors having rail pairs aligned with the rail pairs of the hold for moving said truck means beneath said lifting means.

4. The barge carrying ship according to claim 3, including movable intermediate rails disposed for positioning between said rail pairs of the hold and said rail pairs on said doors.

5. The barge carrying ship according to claim 1, including supports fixedly spaced along said rails and protruding inwardly from the rails to support said barges in stationary stowed accomodation on lowering of said arms.

6. The barge carrying ship according to claim 1, wherein each of said trucks comprise a generally planar body, provided along its lower edge with wheel means for running along said rail, and along its upper edge with guide means, said ship hull being provided with secondary rails adapted to contact said guide means and hold said truck members in position.

7. The barge carrying ship according to claim 1, wherein said truck arms and said barges are provided with cooperating recesses and prongs for removable engagement during transport.

* * * * *